US005973617A

United States Patent [19]

Reichmeyer et al.

[11] Patent Number: 5,973,617

[45] Date of Patent: Oct. 26, 1999

[54] CONTROL CIRCUIT WITH ADJUSTABLE STANDBY OSCILLATOR

[75] Inventors: Hans Reichmeyer, Grafing; Francesco Colandrea, Harr, both of Germany

[73] Assignee: STMicroelectronics GmbH, Grasbrunn, Germany

[21] Appl. No.: 08/851,872

[22] Filed: May 6, 1997

[30] Foreign Application Priority Data

May 6, 1996 [DE] Germany ..... 196 18 094

[51] Int. Cl.[6] ..... G08C 19/00

[52] U.S. Cl. ..... 340/825.71; 235/382; 368/201; 340/333

[58] Field of Search ..... 340/825.71, 333, 340/825.69, 825.72; 235/382, 382.5; 331/46, 78, 48, 47; 455/38.3, 343, 528; 368/156, 168, 201; 70/3, 278

[56] References Cited

U.S. PATENT DOCUMENTS

| | | | |
|---|---|---|---|
| 4,264,967 | 4/1981 | Fujita et al. | 368/156 |
| 4,344,046 | 8/1982 | Zumsteg | 331/158 |
| 4,456,386 | 6/1984 | Dellea | 368/201 |
| 4,631,496 | 12/1986 | Borras et al. | 331/1 |
| 4,857,917 | 8/1989 | Sato | 340/825.57 |
| 5,280,650 | 1/1994 | Sobti | 455/343 |

FOREIGN PATENT DOCUMENTS

| | | |
|---|---|---|
| 0 015 873 B2 | 9/1980 | European Pat. Off. . |
| 0 118 108 B1 | 9/1984 | European Pat. Off. . |
| 0 457 964 A1 | 11/1991 | European Pat. Off. . |
| 0 586 256 A2 | 3/1994 | European Pat. Off. . |
| 42 21 142 A1 | 1/1994 | Germany . |
| 43 02 232 A1 | 8/1994 | Germany . |

*Primary Examiner*—Michael Horabik
*Assistant Examiner*—Anthony Asongwed
*Attorney, Agent, or Firm*—David V. Carlson; Seed and Berry LLP

[57] ABSTRACT

A control circuit adapted to be switched to a standby mode during periods without control requirement and to be repeatedly reset during the standby mode of operation for a short wake-up period each to a full mode of operation. The control circuit comprises a standby oscillator that is operative also in the standby mode and that is adjusted during wake-up periods.

40 Claims, 2 Drawing Sheets

CONTROL CIRCUIT WITH ADJUSTABLE STANDBY OSCILLATOR

TECHNICAL FIELD

The invention relates to a control circuit through which electrical means can be controlled and the operating states thereof can be monitored.

BACKGROUND OF THE INVENTION

Such a control circuit is used, for example, for controlling and monitoring a central locking means of a motor vehicle. Such a control means can be used quite generally for controlling and monitoring a so-called automatic state apparatus which is capable of producing a predetermined number of states, changes from one state to another state on the basis of actual states and input variables and produces output signals in doing so.

DE 42 21 142 A1 discloses a central locking system for a motor vehicle, comprising a transmitter incorporated in a door key and a receiver accommodated in the motor vehicle. By means of the transmitter, a code is transmitted that is decoded by the receiver and causes actuation of the central locking system when the correct code has been transmitted. Transmitter and receiver thus constitute a remote control means. For permitting the latter to operate selectively either with radio frequencies or with light frequencies, there are provided on the transmitter side both an HF oscillator and a light wave oscillator whose HF carrier and light wave, respectively, can each be modulated with the code word on the transmitter side, and on the receiver side there are provided both a HF detector and a light wave detector whose output signals are fed to a common decoder means.

U.S. Pat. No. 417 discloses a remotely controllable central locking system for a motor vehicle, with the receiver thereof, which is arranged within the motor vehicle, being periodically turned on and off in order to reduce the overall power consumption. For making sure that the central locking system is definitely responsive in case of transmission of a code signal from a transmitter, the code pulse sequence on the transmitter side is preceded by a leader pulse having a duration that is longer than the time distance between two successive on-state intervals of the receiver. In this manner, the receiver is safely activated by the leader pulse, so as to be able to receive and process the code pulse sequence thereafter. To this end, the receiver is provided with a clock pulse generator delivering clock pulses corresponding to the on-state intervals of the receiver to a first input of an AND circuit. A second input of the AND circuit is fed with pulses that are received by the transmitter and shaped. If a pulse from the transmitter is received by the timer during a clock pulse, the then created output signal of the AND circuit triggers a monostable multivibrator, the output signal of which turns on a power supply of the receiver for a predetermined period of time that is at least as long as the code pulse sequence transmitted by the transmitter subsequently to a leader pulse. When no pulse from the transmitter has been received during a clock pulse, the power supply of the receiver is turned on only for the particular duration of the clock pulse.

EP 0 457 964 A1 reveals a remote operating system for controlling additional apparatus for vehicles, whose receiver arranged in the vehicle is periodically turned on and off in order to reduce the average power consumption of the receiver. During a transmission operation, the transmitter is turned on each time for a period of time of such duration that at least one on-state interval of the receiver is present therein so that the receiver can definitely be responsive to a transmission operation.

DE 43 02 232 A1 discloses an apparatus for operating a microprocessor, by means of which the microprocessor can be operated in an active and in an inactive operating state so as to reduce the load acting on the battery supplying current to the microprocessor. In the inactive state, the microprocessor may be brought to the active state either by a wake-up signal of a watchdog provided in the microprocessor or by an external wake-up signal issued periodically by an external oscillator. The external oscillator is composed with two CMOS inverters.

A conventional control circuit of the type indicated at the outset comprises a control means, which may be a microcontroller, and a main oscillator delivering a clock signal for operation of the control means. In addition thereto, such a control circuit may contain a state monitoring means through which the states of predetermined electrical means, such as electrical switching contacts, sensors and/or detectors, can be monitored and state signals representing the respective states can be delivered to the control means.

Due to the high clock frequencies that may be employed by digital control means of modem nature, in particular in the form of the already mentioned microcontrollers, quartz oscillators are used having oscillation frequencies in the MHz range. Both such control means as well as such oscillators consume relatively much power, which may turn out problematic for example in such cases in which the means controlled by the control circuit is not required for long periods of time. If such a control circuit is used, for example, for controlling a central locking system of a motor vehicle, it may happen that the control circuit is not being used for a long period of time, for example when the motor vehicle is not in use for days, weeks or even months. In order to avoid that the electrical source of energy, in the example mentioned a motor vehicle battery, is subjected to undesirable loads, it is known to switch the control circuit, when its control function is not required for a longer period of time, to a current-saving waiting or standby mode of operation in which control circuit components with relatively high power consumption, such as the control means and the oscillator, are turned off.

In the standby mode, only such parts of the control circuit are kept in the on-state mode which serve for state control of electrical means, such as sensors, detectors and switch contacts. In this manner, it is possible to determine when a need for control by the control unit arises again, so as to be able to reset the control circuit to full operation thereof in case of such determination. Control circuit parts that are deactivated during standby operation are thus put into operation again.

For reasons of functional safety, the control circuit is also reset to full operation for a short wake-up period each when no control necessity is present. Such temporary resetting to full operation usually takes place periodically. For example, after standby periods of a duration of several seconds each, resetting to full operation takes place for a wake-up period of several milliseconds each. In this example, the control circuit is in full operation only in the range of some few percent of the total time, and the remaining time in the standby mode. The average power consumption by the control circuit parts with noticeable power consumption is correspondingly reduced to some few percent of the power consumption that would arise if the control circuit were kept in full operation at all times.

For controlling the control circuit parts held in the on-state during the standby mode as well as for controlling the alternating standby periods and periods of full operation, an oscillator is required for making available clock signals necessary therefor, and the frequency of these clock signals may be considerably lower than that of the clock signals fed from the quartz oscillator to the control means. Due to the fact that the quartz oscillator is turned off during the standby mode, this known control circuit uses, in addition to the quartz oscillator serving as main oscillator, a second oscillator serving as a standby oscillator that is permanently in operation and has a considerably lower oscillation frequency than the main oscillator and a considerably lower power consumption than the main oscillator. In conventional manner, for example an RC oscillator or an IC oscillator is employed as standby oscillator, with a capacitor thereof being periodically charged and discharged with the aid of a current source and a switch.

Such standby oscillators involve problems in so far as the frequency stability thereof is not very good.

SUMMARY OF THE INVENTION

The present invention thus is to make available measures for overcoming this problem. According to the invention, this is achieved by a control circuit with a high power consuming full operation mode and a low power consuming standby mode wherein the timing control for both modes is an inaccurate oscillator timer which is adjusted during every full operation mode by an accurate oscillator timer.

The control circuit according to the invention can be switched to a standby mode of operation during periods of time without control necessity, and during such standby operation can be reset repeatedly to full operation for a short wake-up period each. The control circuit includes a full operation circuit part that is operable only during full operation of the control circuit, and a frequency-stable main oscillator having a relatively high power demand. It comprises a standby circuit part that is operable both in the full mode and in the standby mode of operation and has an adjustable standby oscillator which as such is inaccurate in terms of frequency and consumes little power. The standby oscillator is adjusted during wake-up periods with the assistance of the main oscillator.

In an embodiment of the invention, the full operation circuit part comprises a control means and the standby circuit part contains a frequency control means in which a frequency control signal can be stored, and a wake-up means which is controlled by an output signal of the standby oscillator and by means of which at least the control means and the main oscillator are adapted to be brought into full operation each during the wake-up periods. There is provided a frequency measuring means through which a measurement of the actual oscillator frequency of the standby oscillator can be carried out during each wake-up period. This embodiment comprises a frequency correction means through which the actual oscillator frequency measured during the particular wake-up period is compared to a set oscillator frequency and by means of which a corrected frequency control signal can be generated that is a function of the particular comparison result and can be stored in the frequency control means as new frequency control signal each.

With such a control circuit, the actual frequency of the standby oscillator is thus measured during each wake-up operation and, in case of a deviation of the actual frequency of the standby oscillator from its set frequency, an adjustment of the standby oscillator to the desired set frequency is effected. Due to the relatively short time intervals between the individual wake-up periods, the standby oscillator thus maintains its set frequency with very high reliability despite its inherently poor frequency stability.

In a preferred embodiment of the invention, the control circuit contains a state monitoring means through which, during standby operation of the control circuit, the respective states of predetermined sensors and/or detectors and/or other electrical means can be monitored and the control circuit can be reset to full operation upon detection of predetermined states.

The control circuit may have a microcontroller having at least one interrupt input via which the microcontroller can be reset from standby operation to full operation.

In an embodiment of the invention, the frequency of the standby oscillator may be controllable by means of a digital frequency control signal. When an IC oscillator is employed as standby oscillator, a plurality of differently weighted adjustment current sources may be provided, with the digital frequency control signal determining which ones of the adjustment current sources are turned on each for charging a capacitor of the standby oscillator.

The frequency control means may comprise a frequency control signal register in which the frequency control signal that has arisen during the particular wake-up period from a comparison between actual and set frequencies of the standby oscillator, can be stored and the memory contents of which determine the particular frequency of the standby oscillator by means of a frequency comparator means.

The frequency measuring means may have a time gate means through which, during the respective wake-up period, a time gate having a gate duration depending on the oscillation period actual duration of the standby oscillator is opened, the number of oscillations of the main oscillator occurring during the gate duration is counted and the count thus obtained is compared with a reference count value corresponding to the oscillation period set duration of the standby oscillator.

The control circuit according to the invention is suitable for a central locking system for a motor vehicle, which has several electrical switch contacts which are associated, for example, with locks located in different locations in the motor vehicle and of which at least part changes its switching state upon actuation of the central locking system. The function monitoring means of the control circuit can be used for monitoring the switching states of at least part of the switch contacts. If an alteration of the switching state of at least one of the electrical contact is detected in the standby mode, resetting to full operation is effected.

BRIEF DESCRIPTION OF THE DRAWINGS

The invention shall now be elucidated in more detail by way of embodiments as shown in the drawings.

DETAILED DESCRIPTION OF THE INVENTION

Figure 1:
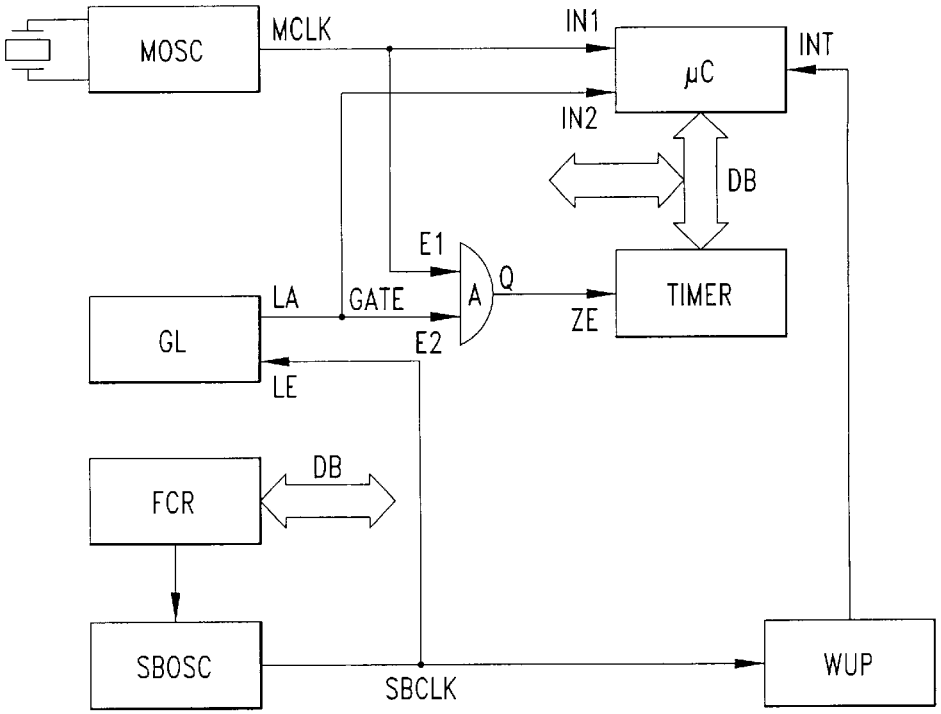
FIG. 1 shows a block diagram of an embodiment of a control circuit according to the invention.

The embodiment of a control circuit according to the invention, illustrated in FIG. 1 in the form of a block diagram, comprises as control means a microcontroller $\mu$C which is subject to the timing clock control of a main oscillator MOSC which is designed as a quartz oscillator and from which microcontroller $\mu$C receives a main clock signal MCLK via a first microcontroller input IN1. In addition thereto, this control circuit comprises a standby oscillator SBOSC generating a standby clock signal SBCLK. The latter is delivered to a wake-up circuit WUP. This circuit, under the control of the standby clock signal SBCLK, periodically generates a wake-up signal and delivers the same to an interrupt input INT of microcontroller $\mu$C. The wake-up signal is generated during each $n^{th}$ clock pulse of the standby clock signal SBCLK, in which n may be an arbitrary integer.

The frequency of standby oscillator SBOSC is tunable, with the aid of a digital frequency control signal FCS that can be stored in a frequency control signal register FCR. By changing the memory contents of FCR, the clock frequency SBCLK can be varied.

Figure 3:
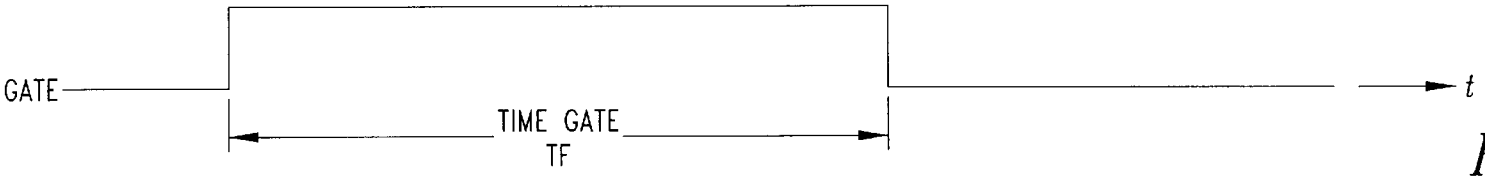
FIG. 3 shows a time gate of the control circuit depicted in FIG. 1.
Figure 4:
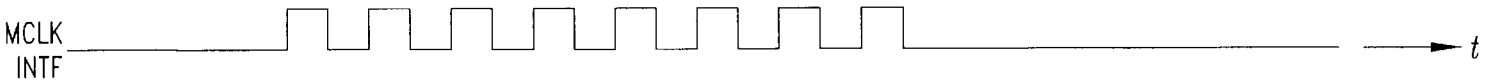
FIG. 4 shows clock signals of the main oscillator, as taken out with the aid of the time gate.

The control circuit furthermore comprises as frequency measuring means a TIMER communicating with the microcontroller via a data bus DB. The frequency measuring means TIMER comprises a time measurement input ZE connected to the output of an AND circuit A which has a first input E1 connected to the output of main oscillator MOSC, a second input E2 connected to the output of a gate logic GL, and an output O connected to the time measurement input ZE. The gate logic GL has a logic input LE to which is supplied the standby clock signal SBCLK. Within each $m^{th}$ wake-up period duration, in which m may be an arbitrary integer and preferably is 1, gate logic GL generates, under the time control of SBCLK, at a logic output LA a gate signal GATE determining the duration of a time gate TF (FIG. 3) and being supplied on the one hand to the second input E2 of A and on the other hand to a second microcontroller input IN2. During the duration of this gate signal GATE, the AND circuit A allows the main clock signal MCLK (FIG. 2) of the main oscillator MOSC to pass. The frequency measuring means TIMER counts the number of clock pulses of main clock signal MCLK supplied thereto during the particular time gate TF (FIG. 4). At the end of the respective time gate TF, which is reported to microcontroller $\mu$C by the gate logic GL via the second microcontroller input IN2, microcontroller $\mu$C retrieves from the frequency measuring means TIMER the count obtained at the end of time gate TF, via data bus DB.

Figure 2:
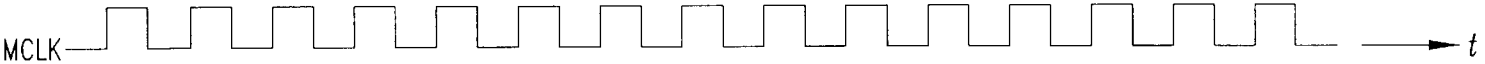
FIG. 2 shows clock signals of a main oscillator of the control circuit depicted in FIG. 1.

Main oscillator MOSC has for example a frequency of 8 MHz and standby oscillator SBOSC has for example a frequency of 32 kHz. Time gate TF, which is closely correlated to the frequency of standby oscillator SBOSC and, for example, has the duration of one clock pulse of SBCLK, thus is capable of containing considerably more clock pulses MCLK in practical application than is shown in FIGS. 2 to 4.

Microcontroller $\mu$C has stored therein a set count corresponding to a predetermined set frequency of standby oscillator SBOSC. The count delivered to microcontroller $\mu$C at the end of a time gate TF by TIMER, which count corresponds to the respective actual frequency of standby oscillator SBOSC and thus is referred to as actual count, is compared in microcontroller $\mu$C to the set count. If the respective actual count differs from the set count, microcontroller $\mu$C produces a correction signal and, responsive thereto, a digital frequency control signal FCS which is written into frequency control signal register FCR by microcontroller $\mu$C via data bus DB. In addition thereto, the TIMER is reset again to an initial count of 0, for example.

The respective frequency control signal written into frequency control signal register FCR then determines the particular frequency of standby oscillator SBOSC, until a new frequency control signal is delivered to frequency control signal register FCR by microcontroller $\mu$C.

Figure 5:
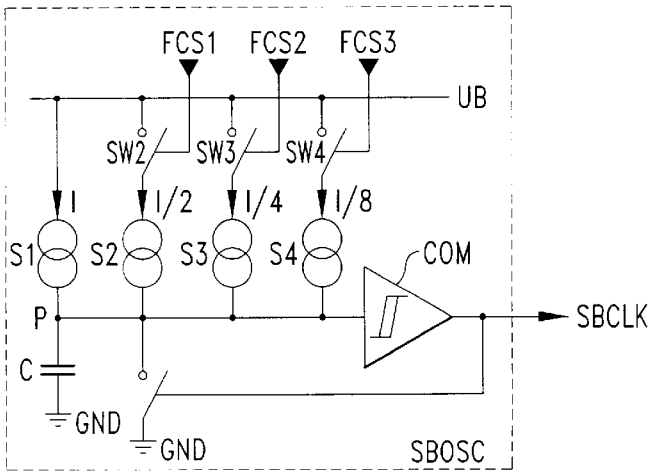
FIG. 5 shows an embodiment of a standby oscillator that can be used in the control circuit according to FIG. 1.

FIG. 5 shows a preferred embodiment of a standby oscillator SBOSC suitable for the control circuit according to the invention. This standby oscillator, in a manner known per se, is composed as an IC oscillator, i.e., an oscillator having a capacitor which in periodically alternating manner is charged by means of a current source means and discharged by means of a switch.

The oscillator shown in FIG. 5 comprises a series connection inserted between a supply voltage source UB and a ground terminal GND and comprising a capacitor C and four current sources S1 to S4 connected in parallel to each other. Capacitor C has a first switch SW1 connected in parallel thereto. A circuit point P between capacitor C and current sources S1 to S4 is connected to an input of a comparator COM whose output signal controls the switching state of switch SW1. Current source S1 serves as main current source and is permanently connected to capacitor C. Current sources S2 to S4 serve as adjustment current sources.

Between each of adjustment current sources S2 to S4 and voltage supply source UB, there is connected one of three switches SW2 to SW4. The switching states of switches SW2 to SW4 are controlled by means of switch control signals FCS1, FCS2 and FCS3, respectively, which are various bit positions of frequency control signal FCS stored in frequency control signal register FCR.

Adjustment current sources S2 to S4 deliver current values of different magnitude $I_1$, $I_{1/2}$ and $I_{1/4}$, respectively, and are weighted in accordance with the binary system.

The oscillator depicted in FIG. 5 operates such that, when switch SW1 is opened, capacitor C is charged with the current at least of main current source S1. The charging voltage of capacitor C increases correspondingly until this charging voltage reaches a predetermined reference value, whereupon comparator COM generates an output signal switching switch SW1 to its conducting state, thus causing sudden discharge of capacitor C. This alternating charging and discharging of the capacitor is repeated periodically, with the steepness of the rise in charging voltage and thus the particular duration of the charging operation being dependent upon the charging current intensity. The latter in turn is dependent upon how many of the adjustment current sources S2 to S4 are turned on by means of the associated switches SW2 to SW4. And this is determined by the respective digital frequency control signal FCS stored in frequency control signal register FCR.

In the embodiment in which the control circuit is used in a motor vehicle, the wake-up circuit WUP may receive inputs from many different sources to wake-up the microcontroller $\mu$C on the occurrence of selected actions, for example, it may be utilized at the same time as a monitoring means for monitoring the respective states of predetermined sensors and/or detectors or other electrical means (not shown), for example electrical switch contacts associated with various locks of the motor vehicle, head lights, door positions, air conditioning units, or other electronic circuits in the automobile.

The operation of the control circuit shown in FIG. 1 will now be explained using as one example the case in which the control circuit is used in connection with the control of a central locking system for a motor vehicle.

It is assumed first that the entire control circuit is operating, i.e., in full operation. When no control requirement of the control circuit has been detected by the state monitoring means during a predetermined period of time, for example since either the vehicle in its entirety is not in use or since the central locking system has not been operated for a longer period of time, microcontroller $\mu$C is stopped by a stop command in its momentary, current program step and is turned off.

Such turning off has an effect only on microcontroller $\mu$C and main oscillator MOSC and possibly on further means of the circuit arrangement that are not shown in FIG. 1. The other circuit parts shown in FIG. 1, namely standby oscillator SBOSC, frequency control signal register FCR, gate logic GL, TIMER, and wake-up circuit WUP are not affected by said turning off, but remain turned on for maintaining the standby operation.

During this standby operation, the standby clock circuit SBOSC, periodically and after specific time intervals as has been described, for example after 1 s each, outputs a signal on line SBCLK to the WUP. Upon the WUP receiving the signal on SBCLK it outputs an interrupt signal on line INT to turn on microcontroller $\mu$C via input INT for a respective wake-up period of, e.g., 1 ms, which causes also main oscillator MOSC to be turned on. During the respective wake-up period, a time gate TF is produced by means of gate logic GL, the comparison between actual frequency and set frequency of standby oscillator SBOSC is carried out with the aid of $\mu$C, and the new frequency control signal which is a function of the result of this comparison is written into frequency control signal register FCR, which causes a corresponding control operation of switches SW2 to SW4 of standby oscillator SBOSC shown in FIG. 5. After expiration of the wake-up period, microcontroller $\mu$C and main oscillator MOSC are turned off again.

If wake-up circuit WUP, with respect to one or several of the contacts monitored by it, detects a change of state during a standby duration, it directly, i.e., without waiting for the next wake-up period, issues an interrupt command, acting as a wake-up signal, via interrupt input INT to microcontroller $\mu$C, whereupon the latter and the main oscillator MOSC are turned on and the control circuit is thus reset to full operation. Due to the fact that microcontroller $\mu$C is turned off by a respective stop command, microcontroller $\mu$C during each wake-up operation resumes its operation in that program step in which it has been turned off before by the stop command.

While the invention has been described with respect for use in an automobile, it may also be used in a circuit, such as a portable computer, printer, or any other circuit having a microcomputer or microprocessor therein which is periodically placed in a sleep mode for power savings.

What is claimed is:

1. A control circuit switchable to a standby mode of operation during times without control requirement and to be repeatedly reset during the standby mode of operation for a short wake-up period each to a full mode of operation;

said control circuit comprising:

a full operation circuit part that is operable only during full operation of the control circuit and has a frequency-stable main oscillator with relatively high power consumption;

and a standby circuit part that is operable both in the full mode and in the standby mode of operation and has an as such frequency-inaccurate, adjustable standby oscillator with relatively low power consumption;

with said standby oscillator being adjustable during wake-up periods with the aid of the main oscillator.

2. The control circuit of claim 1, a. with the full operation circuit part thereof comprising a control means;

b. with the standby circuit part thereof comprising a frequency control means in which a frequency control signal controlling the oscillator frequency of said standby oscillator can be stored, and a wake-up means which is controlled by an output signal of said standby oscillator and through which, during the wake-up periods, at least said control means and said main oscillator can be brought into full operation each;

c. said control circuit comprising a frequency measuring means through which a measurement of the actual oscillator frequency of said standby oscillator can be carried out during each of said wake-up periods; and d. comprising a frequency correction means through which the actual oscillator frequency measured during the respective wake-up period is comparable to a set oscillator frequency and through which a corrected frequency control signal can be produced that is a function of the particular comparison result, and can be stored as new frequency control signal each in said frequency control means.

3. The control circuit of claim 1, comprising a state monitoring means through which, in the standby mode of said control circuit, the particular states of predetermined sensors and/or detectors and/or other electrical means can be monitored and said control circuit is resettable to full operation upon detection of predetermined states.

4. The control circuit of claim 2, wherein said control means comprises a microcontroller having at least one interrupt input through which said microcontroller is resettable from the standby mode to full operation.

5. The control circuit of claim 1, wherein the frequency of said standby oscillator is controllable by means of a digital frequency control signal.

6. The control circuit of claim 5, wherein said standby oscillator comprises a ramp generator with a ramp steepness that is switchable in accordance with said digital frequency control signal.

7. The control circuit of claim 6, wherein said ramp generator comprises a capacitor which, in periodically alternating manner, is chargeable by means of a current source circuit and discharged by means of a discharging means, said current source circuit having a main current source connected in series with said capacitor and determining the basic frequency of said standby oscillator, and a plurality of differently weighted adjustment current sources connected in parallel with said main current source, wherein each of said adjustment current sources has a controllable switch connected in series therewith and said switches are controllable as a function of said frequency control signal.

8. The control circuit of claim 7, wherein the individual adjustment current sources have a current intensity weighting system corresponding to the binary system.

9. The control circuit of claim 5, wherein said frequency control means comprises a frequency control signal register in which the respective digital frequency control signal delivered by the frequency comparator means can be stored and whose memory contents determine the respective frequency of said standby oscillator.

10. The control circuit of claim 2, wherein said frequency measuring means comprises a time gate means through which, during the respective wake-up period, a time gate is opened having a gate duration corresponding to the oscillation period actual duration of said standby oscillator, the number of the oscillations of said main oscillator occurring during said gate duration is counted and the thus obtained count is compared by means of said frequency comparator means to a reference count corresponding to the oscillation period set duration of said standby oscillator.

11. The control circuit of claim 10, wherein said frequency measuring means comprises:

a gate logic means having a logic input structured to receive the output signal of the standby oscillator, and a logic output from which a gate signal is available;

an AND circuit having a first input coupled to the output of said main oscillator, a second input coupled to said logic output, and an output coupled to a counting input of a counter adapted to count the main oscillator oscillations occurring during a gate duration.

12. A central locking system for a motor vehicle, comprising:

a plurality of electrical switch contacts associated with locks located in different locations of said motor vehicle and of which at least part thereof changes its switching state upon actuation of said central locking system;

a control circuit having a full operation circuit and a standby circuit;

the full operation circuit operable only during full operation of the control circuit and having a main oscillator with a given accuracy, the main oscillator drawing a given amount of power;

the standby circuit operating both during full operation and standby mode operation, the standby circuit having an adjustable oscillator less accurate than and drawing less current than the main oscillator;

frequency control means included in the standby circuit for controlling the frequency of the adjustable oscillator;

wake-up means included in the standby circuit for causing the control circuit to change to full operation mode from standby mode operation;

a timer circuit for measuring the frequency of the adjustable oscillator;

frequency control means for comparing the frequency of the adjustable oscillator to the main oscillator frequency and storing the result in the frequency control means; and state monitoring means for monitoring states of sensors and for causing the control circuit to operate in full operation mode upon detection of predetermined states of the sensors.

13. A control circuit operating in an active mode which consumes an amount of power and a standby mode which consumes less power than the active mode, the control circuit including:

a full operation circuit coupled to a standby circuit, the full operation circuit including a first oscillator having a given accuracy and which uses a given amount of power, and including frequency control circuitry;

the standby circuit including a second oscillator which is less accurate than and uses less power than the first oscillator;

an active mode signal generated by the standby circuit, the active mode signal for causing the control circuit to operate in the active mode for a controllable time period, the absence of the active mode signal for causing the control circuit to operate in the standby mode; and calibration signals generated by the frequency control circuitry for calibrating the second oscillator each time the control circuit operates in the active mode.

14. The control circuit of claim 13 wherein the control circuit further includes:

a microcontroller having an interrupt input for accepting the standby mode and active mode signals;

a timer circuit coupled to the microcontroller to count a number of oscillations of the first oscillator during the controllable time period; and a control gate coupled between the first oscillator and the timer circuit, the control gate structured to generate a counting signal supplied to the timer circuit.

15. The control circuit of claim 14, further including:

wake-up circuitry coupled between the second oscillator and the microcontroller, the wake-up circuitry for accepting the active mode signal from the standby circuit and generating, based on the active mode signal, an interrupt passed to the microcontroller.

16. The control circuit of claim 13 wherein the second oscillator is comprised of:

a current generator that is always enabled;

a plurality of current generators each having a different current generating capacity;

a plurality of current generator switches, each switch for accepting a respective one of a plurality of charging signals from the frequency control circuitry and each enabling a respective one of the plurality of current generators;

a capacitor charged to a voltage by the current generators and discharged once a threshold voltage is reached;

a comparator for comparing the capacitor voltage to the threshold voltage and generating a discharge control signal when the capacitor voltage equals the threshold voltage; and a switch enabled by the discharge control signal to discharge the capacitor voltage towards a ground voltage.

17. The control circuit of claim 16, further including:

a frequency control signal generated by a microcontroller, the frequency control signal generated each time the active mode is entered and used by the frequency control circuitry for generating the plurality of charging signals, one for each switch of the second oscillator.

18. The control circuit of claim 17 wherein the plurality of charging signals enable more or less current generators in the standby circuit.

19. The control circuit of claim 16 wherein the number of the plurality of generators is three and the current generators generate current in a ratio of 1:1/2:1/4:1/8.

20. A central locking signal for a motor vehicle including:

electrical switch contacts connected to door locks located about the motor vehicle;

a control circuit operating in an active mode which consumes an amount of power and a standby mode which consumes less power than the active mode, the control circuit coupled to the electrical switch contacts, including:

a full operation circuit coupled to a standby circuit, the full operation circuit including a first oscillator having a given accuracy and which uses a given amount of power, and including frequency control circuitry;

the standby circuit including a second oscillator which is less accurate than and uses less power than the first oscillator;

an active mode signal generated by the standby circuit, the active mode signal for causing the control circuit to operate in the active mode for a controllable time period, the absence of the active mode signal for causing the control circuit to operate in the standby mode; and adjusting signals generated by the frequency control circuitry for adjusting the frequency of the second oscillator each time the control circuit operates in the active mode.

21. The central locking system of claim 20 further comprising:

a microcontroller having an interrupt input for accepting the standby mode and active mode signals;

a timer circuit coupled to the microcontroller to count a number of oscillations of the first oscillator during the controllable time period; and a control gate coupled between the first oscillator and the timer circuit, the control gate for generating a counting signal.

22. The central locking system of claim 21, further including:

wake-up circuitry coupled between the second oscillator and the microcontroller, the wake-up circuitry for accepting a signal from the standby circuit and generating, based on the signal, an interrupt passed to the microcontroller.

23. The central locking system of claim 20 wherein the second oscillator is comprised of:

four current generators each having a different current generating capacity, at least one of the current generators being always enabled;

three current generator switches each for accepting one of a plurality of charging signals from the frequency control circuitry and each enabling a respective one of the current generators;

a capacitor charged to a voltage by the current generators and discharged once a threshold voltage is reached;

a comparator for comparing the capacitor voltage to the threshold voltage and generating a discharge control signal when the capacitor voltage equals the threshold voltage; and a switch enabled by the discharge control signal to discharge the capacitor voltage towards a ground voltage.

24. The central locking system of claim 23, further including:

a frequency control signal generated by a microcontroller in the full operation circuit, the frequency control signal generated each time the active mode is entered, and used by the frequency control circuitry for generating the plurality of charging signals, one for each switch of the second oscillator.

25. The central locking system of claim 24 wherein the plurality of charging signals enable more or less current generators in the standby circuit.

26. The central locking system of claim 23 wherein the four current generators generate different amounts of current in a ratio of 1:1/2:1/4:1/8.

27. A method of controlling a circuit having more than one state using an accurate oscillator and an inaccurate oscillator comprising the steps of:

operating the circuit in an active mode;

generating a standby mode signal using the inaccurate oscillator;

switching circuit operation to a standby mode based on the standby mode signal;

generating an active mode signal using the inaccurate oscillator;

switching to the active mode; and calibrating the inaccurate oscillator based on the accurate oscillator.

28. The method of claim 27 wherein the standby mode signal is generated by the steps of:

charging a capacitor with one or more current sources;

comparing the voltage on the capacitor to a threshold voltage using a voltage comparator circuit;

using the comparator circuit output to generate the standby mode signal; and discharging the capacitor when the standby mode signal is generated.

29. The method of claim 27 wherein the step of calibrating the inaccurate oscillator comprises the steps of:

counting the number of oscillations by the accurate oscillator during a time period depending on the actual oscillations by the inaccurate oscillator and generating a comparison value;

comparing the counted number of oscillations with a stored target value and generating a comparison value based on the difference; and enabling more or less current sources based on the comparison value.

30. In a circuit having a frequency stable oscillator producing a first signal and a frequency instable oscillator producing a second signal, a method of producing a frequency stable oscillation signal comprising:

continuously operating the frequency instable oscillator;

starting the frequency stable oscillator;

comparing the first signal to the second signal and generating calibration signals based on the comparison;

calibrating the frequency instable oscillator using the calibration signals.

31. The method of claim 30 further comprising stopping the frequency stable oscillator.

32. The method of claim 30 wherein generating calibration signals comprises:

counting the number of oscillations of the first signal during a time period measured by the second signal; and comparing the counted number of oscillations with a stored target value and generating a frequency control signal based on the comparison.

33. A control circuit comprising:

a frequency-stable main oscillator having a frequency-stable output;

a frequency-inaccurate, adjustable oscillator having a frequency instable output;

a comparison circuit coupled to both the main oscillator and the adjustable oscillator and structured to compare the frequency stable output to the frequency instable output; and a calibration circuit coupled to the comparison circuit and to the adjustable oscillator and structured to calibrate the adjustable oscillator to adjust the frequency instable output.

34. The control circuit of claim 33 further comprising:

a wake-up circuit coupled to the adjustable oscillator for generating a wake-up signal, based on the frequency instable output.

35. The control circuit of claim 34 wherein the comparison circuit operates only in a wake-up period following the wake-up signal.

36. The control circuit of claim 35 wherein the wake-up period is 1 ms.

37. The control circuit of claim 33 wherein the adjustable oscillator comprises:

a plurality of current sources that each supply an amount of current responsive to the state of a respective plurality of switches; and a capacitor coupled to the current sources that is charged by the current sources and is discharged responsive to a controlled switch.

38. The control circuit of claim 37 wherein the adjustable oscillator further comprises:

a current source that is always sourcing current to the capacitor.

39. The control circuit of claim 37 wherein the adjustable oscillator further comprises:

a comparator coupled to the capacitor, the comparator having an output coupled to the controlled switch.

40. The control circuit of claim 39 wherein the output of the comparator is an output of the adjustable oscillator.

* * * * *